US006458317B1

(12) United States Patent
Koskinen et al.

(10) Patent No.: US 6,458,317 B1
(45) Date of Patent: Oct. 1, 2002

(54) METHOD FOR FORMING A NICKLE-TITANIUM PLATING

(75) Inventors: Jari Koskinen, Espoo; Eero Haimi, Helsinki, both of (FI)

(73) Assignee: Valtion Teknillinen Tutkimuskeskus, Espoo (FI)

( * ) Notice: Subject to any disclaimer, the term of this patent is extended or adjusted under 35 U.S.C. 154(b) by 0 days.

(21) Appl. No.: 09/719,385

(22) PCT Filed: Jun. 14, 1999

(86) PCT No.: PCT/FI99/00519

§ 371 (c)(1),
(2), (4) Date: Feb. 12, 2001

(87) PCT Pub. No.: WO99/66102

PCT Pub. Date: Dec. 23, 1999

(30) Foreign Application Priority Data

Jun. 12, 1998 (FI) ..... 981357

(51) Int. Cl.[7] ..... B22F 7/04
(52) U.S. Cl. ..... 419/8; 419/46; 419/48
(58) Field of Search ..... 419/8, 9, 48, 46

(56) References Cited

U.S. PATENT DOCUMENTS

| | | | | |
|---|---|---|---|---|
| 4,252,867 A | | 2/1981 | Nemoto et al. | |
| 4,863,810 A | * | 9/1989 | Bhattacharya et al. | 428/661 |
| 5,078,848 A | * | 1/1992 | Anttila et al. | 204/192.38 |
| 5,316,599 A | * | 5/1994 | Ebato et al. | 148/512 |
| 5,368,661 A | * | 11/1994 | Nakamura et al. | 148/512 |

FOREIGN PATENT DOCUMENTS

| | | |
|---|---|---|
| DE | 1 621 392 | 5/1971 |

* cited by examiner

*Primary Examiner*—Daniel J. Jenkins
(74) *Attorney, Agent, or Firm*—Young & Thompson

(57) ABSTRACT

A plating material mainly consisting of nickel-titanium is hot pressed onto a surface.

21 Claims, No Drawings

METHOD FOR FORMING A NICKLE-TITANIUM PLATING

The present invention relates to a method for forming a nickel-titan plating.

Nickel-titan (NiTi) is an intermetallic compound. A form of this compound having a certain micro-structure is known to have pseudoelastic properties. In this context, pseudoelasticity refers to an unusually large reversible expansion after stress, a phenomenon not based on the ordinary elasticity of materials that is associated with the stretching of atomic bonds. Due to its pseudoelasticity, NiTi may have a maximum reversible expansion as large as 8%, depending on the exact composition, microstructure and temperature of the compound. Typically, it has been established that, due to pseudoelasticity, NiTi compounds have an excellent cavitation strength, and they have also been found to have a good erosion and corrosion resistance in different environments. In particular, NiTi has proved to have a very good resistance to particle, liquid droplet and cavitation erosion. These properties make NiTi compounds an ideal material for use in e.g. water turbine blades and in process industry equipment, such as pumps, mixers, etc.

As NiTi compounds are expensive and difficult to manufacture, it is not economical to make whole parts from NiTi. Instead, in many cases the same advantages and properties can be obtained by plating the desired object with NiTi.

However, NiTi is a difficult plating material because the NiTi microstructure important for pseudoelasticity easily gets destroyed.

As to plating methods, deposition welding and hot spraying involve the problems that it is difficult to achieve a sufficient adhesion at the junction surface and that the microstructure and therefore the properties, especially pseudoelasticity, are difficult to control. For these reasons, the plating methods referred to are not practical where different surfaces and objects are to be protected with a NiTi plating.

A NiTi plating can also be formed by an explosive plating method, which has yielded better results. The method in question is presented in specification U.S. Pat. No. 5,531,369.

Due to the nature of explosive plating, the area to be plated cannot be of a very complex nature in respect of geometry, which is a significant limitation regarding the shape of objects to be plated and therefore the range of use of NiTi plated objects. In the case of large surfaces to be plated, the size of the explosive charge to be used constitutes a limitation.

The object of the invention is to eliminate the problems referred to above. A specific object of the invention is to develop a relatively simple NiTi plating method which can be used to form a plating on geometrically complex and even large surfaces and which produces a plating possessing pseudoelastic properties.

The features characteristic of the invention are presented in the claims.

In the method of the invention, a plating is produced by hot-pressing plating material onto the surface of the object to be plated. The method is implemented using e.g. axial, isostatic or some other known type of hot pressing.

Hot pressing is accomplished using a pressing element and a heating element. The pressing element is arranged to press the plating material against the surface of the object to be plated and the heating element is arranged to heat the area to be pressed. The action of the pressing element may be e.g. hydraulic, mechanical or some other known type of action. The action of the heating element may be any known type of heating action.

The pressure and temperature used in the hot pressing operation are so selected that the surface to be plated and the plating material are in a solid state in the hot pressing conditions. A solid state is conducive to the formation of the desired boundary layer structure and to the formation of the microstructure of the plating.

The pressure, temperature and pressing time used in the hot pressing operation all have an effect on the pseudoelasticity and tensions of the plating produced and also on the thickness and nature of the reaction layer that may be formed during the pressing.

In addition, these properties can be influenced by varying the material of the surface to be plated and the granular size and amount of e.g. a powdery plating material.

The pressure and temperature to be used in the hot pressing operation are preferably so selected that substantially no tensions due to different thermal expansion coefficients are produced between the object to be plated and the plating material even when the plated object cools down. Such tensions impair the adhesion of the plating and have an adverse effect on the plating structure.

The pressure and temperature used in the hot pressing operation are preferably so high that the plating material forms a continuous plating on the surface of the object to be plated.

The pressure used in the hot pressing operation is preferably in the range of 70–150 MPa, more preferably 90–120 MPa.

The temperature used in the hot pressing operation is preferably in the range of 700–1400° C., more preferably 800–1200° C.

The plating material and the surface of the object to be plated are preferably hot-pressed against each other for over 1.5 hours, more preferably over 2 hours, e.g. about 3 hours.

At the final stage of the hot pressing operation, the surface is allowed to cool down, or it is cooled down. The cooling rate is preferably below 5° C./min, e.g. 4.6° C./min, and pressing is continued during the cooling phase. A low cooling rate promotes the formation of the microstructure and prevents tensions due to differences between the thermal expansion coefficients.

The plating material preferably has a nickel content of about 48–57 atom percent in relation to the total amount of nickel and titan. The plating material may also contain small amounts of other materials. The plating material may be in the form of wire, powder or sheet.

The surface to be plated is preferably of such material that the reaction layer formed during hot pressing at the boundary layer between the plating material and the surface to be plated will bind the plating to the surface to be plated.

The surface to be plated is preferably made of austenitic steel. When NiTi is hot-pressed onto the surface of austenitic steel at correct temperature and pressure, a reaction layer is formed at the boundary layer between steel and NiTi that binds the plating to the steel surface extremely well.

By the method of the invention, various objects can be easily NiTi-plated so that the plating shows a microstructure and properties characteristic of the pseudoelasticity of NiTi. When objects are plated by the method of the invention, a reaction layer allowing excellent plating adhesion can be created at the boundary layer between the object to be plated and the plating material. The invention allows large and geometrically more complex surfaces than before to be plated relatively economically, thus making it possible to use NiTi plated parts on a much larger scale than before and. in new areas of technology. In the method of the invention, the thickness and granular structure of the plating can be varied in more diversified ways than before.

In the following, the invention will be described by the aid of an example embodiment.

In a preferred embodiment of the invention, powdery NiTi compound is hot pressed onto the surface of AISI 316 type austenitic steel at a temperature of about 900° C. and at a pressure of about 100 MPa for about 3 hours, whereby the NiTi compound is compacted as a pseudoelastic plating on the steel surface and a tough metastable titan-enriched reaction layer is formed at the boundary layer between the steel and the NiTi compound. The plated object is allowed to cool down at a rate below 5° C./min, about 4.6° C./min, while pressing is continued during the cooling phase.

The object to be plated is a ship's propeller, a water turbine blade, a pump for process industry, a valve, a mixer or some other corresponding device.

The above example has been presented in order to illustrate the invention, without limiting it in any way.

What is claimed is:

1. A method for forming a nickel-titanium plating comprising the steps of:

providing a surface to be plated; and hot pressing a plating material consisting essentially of nickel-titanium onto the surface.

2. The method as defined in claim 1, wherein the hot pressing is performed axially.

3. The method as defined in claim 1, wherein the hot pressing is performed isostatically.

4. The method as defined in claim 1, wherein the hot pressing is performed using a heating device to heat the plating material and a pressing device to press the plating material and the surface against each other.

5. The method as defined in claim 1, wherein the pressure and temperature used in the hot pressing step are so selected that the surface and the plating material remain in solid state.

6. The method as defined in claim 1, wherein the pressure and temperature used in the hot pressing step are so selected that substantially no tensions due to differences regarding thermal expansion coefficients are produced between the surface and the plating material.

7. The method as defined in claim 1, wherein the pressure and temperature used in the hot pressing step are so selected that the plating material forms a compact plating on the surface.

8. The method as defined in claim 1, wherein the pressure used in the hot pressing step is 70–150 MPa.

9. The method as defined in claim 8, wherein the pressure is 90–120 MPa.

10. The method as defined in claim 1, wherein the temperature used in the hot pressing step is 700–1400° C.

11. The method as defined in claim 10, wherein the temperature is 800–1200° C.

12. The method as defined in claim 1, wherein the time for the hot pressing step is over 1.5 hours.

13. The method as defined in claim 12, wherein the time is over 2 hours.

14. The method as defined in claim 1, wherein the surface is cooled as a continuation of the hot pressing step.

15. The method as defined in claim 14, wherein the temperature of the surface is cooled at a rate below 5° C./min.

16. The method as defined in claim 14, wherein the pressing is continued while the surface is being cooled.

17. The method as defined in claim 1, wherein the plating material contains 48–57 atom percent nickel in relation to the total amount of nickel and titanium.

18. The method as defined in claim 1, wherein the plating material comprises a powder, a sheet or a wire.

19. The method as defined in claim 1, wherein the surface comprises a material that forms a strong metastable boundary layer during hot pressing with the plating material.

20. The method as defined in claim 1, wherein at least part of the surface comprises austenitic stainless steel.

21. The method as defined in claim 1, wherein the plating material consists essentially of a nickel-titanium intermetallic compound.

* * * * *